US007032754B2

(12) United States Patent
Kopecky

(10) Patent No.: US 7,032,754 B2
(45) Date of Patent: Apr. 25, 2006

(54) PACKAGE HAVING RELEASEABLY SECURED CONSUMABLE PRODUCTS

(75) Inventor: Stanley J. Kopecky, Prospect Heights, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 506 days.

(21) Appl. No.: 10/003,336

(22) Filed: Oct. 31, 2001

(65) Prior Publication Data

US 2003/0080020 A1 May 1, 2003

(51) Int. Cl.
*B65D 70/00* (2006.01)

(52) U.S. Cl. ..... 206/460; 206/813; 206/800; 206/526; 426/5; 229/87.07

(58) Field of Classification Search ..... 206/460, 206/526, 800, 258, 804, 830, 447, 813; 426/5, 426/124, 115
See application file for complete search history.

(56) References Cited

U.S. PATENT DOCUMENTS 924,275 A * 6/1909 Richardson ..... 206/585
1,490,529 A * 4/1924 Dittgen ..... 206/258
1,751,208 A * 3/1930 Kappes ..... 426/5
2,008,361 A * 7/1935 Lindsey ..... 229/87.05
2,085,728 A * 7/1937 Clark ..... 206/460
2,165,539 A * 7/1939 Dahlgren ..... 206/460
2,192,472 A * 3/1940 Huston ..... 426/5
2,192,473 A 3/1940 Huston
2,210,196 A * 8/1940 Baldwin ..... 426/5
2,744,624 A * 5/1956 Hoogstoel et al. ..... 206/426
2,988,209 A * 6/1961 Parrilla ..... 206/362
3,881,649 A * 5/1975 Krautsack ..... 229/117.12
5,125,211 A 6/1992 O'Brien
5,632,378 A * 5/1997 Provost ..... 206/460
5,797,494 A * 8/1998 Balling et al. ..... 206/460
6,094,917 A * 8/2000 Sundhar et al. ..... 62/3.4

* cited by examiner

*Primary Examiner*—David T. Fidei
(74) *Attorney, Agent, or Firm*—Bell, Boyd & Lloyd LLC

(57) ABSTRACT

The present invention provides an improved product holding and dispensing package and an improved method for manufacturing, holding and storing products, especially consumable products. In an embodiment, a package for a consumable product is provided. The package includes a housing. A sheet is disposed inside the housing. A number of consumable products releaseably attach or adhere to the sheet. The products are configured within the housing so that a consumer can grasp and remove at least one of the consumable products from the sheet and the housing. In an embodiment, the sheet is attached to the housing and the products adhere to the sheet via a heat activated adhesive.

15 Claims, 2 Drawing Sheets

PACKAGE HAVING RELEASEABLY SECURED CONSUMABLE PRODUCTS

BACKGROUND OF THE INVENTION

The present invention relates generally to packaging. More particularly, the present invention relates to packaging for storing and dispensing consumable products and in particular confectionery products.

The packaging for consumable or confectionery products is very important to the look, marketing and storage of the product. Very often, in addition to text on the packaging, the packaging also attempts to visually convey a message about the type of product, the taste of the product or the purpose of the product. For example, packages for cinnamon or cherry tasting products are often red, grape tasting product packaging is often purple, etc. Once the consumer has identified a desired brand, the consumer can typically choose a product based solely on the color of the packaging.

In marketing the product, packaging can convey other information besides taste. For example, certain recent gum products have been developed that have an increased minty taste and that also whiten teeth and freshen breath. The packaging for these products can be made to look like a known tooth paste housing. The consumer can thereby associate the product with its effect by simply viewing the packaging.

There are also practical facets to packaging consumable products, namely, keeping the products from being damaged during shipping, keeping the products fresh, and in certain instances providing a reusable package. Some consumable products do not require that the packaging be robust, sturdy or reusable. For example, candy bars are typically eaten in a single sitting and do not require a reusable package. Candy bars therefore tend to be packaged in thin wrappers that the consumer tears open and discards.

Other consumable products are packaged in pieces and may or may not be provided in a reusable package, as desired by the manufacturer. If it is felt that only a portion of the products may be consumed in one sitting, the manufacturer may wish to provide a box having a hingedly connected lid.

With certain consumable products, such as gum products, the consumer tears open a package and removes a stick or piece of the product. One problem with this type of packaging is that the remaining product tends to fall out of the package after the consumer removes a number of pieces from the package. Another problem with these packages is that it becomes difficult, especially with a newly opened package, to remove a piece without ripping open a significant portion of the package.

Attempting to provide a package that holds the product even after the removal of multiple pieces can make removing the gum more difficult. Tightly packing the product may aid in holding the product at the expense of gaining access to the product.

It is therefore desirable to provide a consumable product package that maintains the products even after a number of the products have been removed.

It is also desirable to provide consumable products in a package, wherein the products are readily accessible and removable.

SUMMARY OF THE INVENTION

The present invention provides an improved product holding and dispensing package and an improved method for manufacturing, holding and storing products, especially consumable products. To this end, in an embodiment, a package for a consumable product is provided. The package includes a housing. A sheet is disposed inside the housing. A number of consumable products releaseably attach to the sheet. The products are configured within the housing so that a consumer can grasp and remove at least one of the consumable products from the sheet and the housing.

In an embodiment, the housing includes a multitude of walls that define an opening. A lid hingedly or rotatably connects to one of the walls, wherein the lid is adapted to fold over and cover the opening.

In an embodiment, one of the walls of the housing defines a cutout. The cutout assists the consumer in grasping and removing the products.

In an embodiment, the sheet is attached to the housing.

In an embodiment, the sheet includes a plurality of adhesive areas and the consumable products releaseably adhere to the adhesive areas of the sheet.

In an embodiment, the adhesive areas are heat activated to adhere the consumable products to the sheet.

In an embodiment, the sheet includes a plurality of wax areas. The wax areas are heat activated to releaseably adhere the consumable products to the sheet.

In an embodiment, the sheet includes wax paper. The wax paper is heat activated in certain areas to adhere the consumable products to the sheet.

In an embodiment, the consumable products are releaseably attached to either side of the sheet.

In an embodiment, the sheet loops around the products and one side of the products releaseably attaches to an inner surface of the looped sheet.

In an embodiment, multiple sides of the products releaseably attach to inner surfaces of the looped sheet.

In an embodiment, the products are directly releaseably attached to the sheet.

In an embodiment, the products are individually contained in wrappers, wherein the wrappers releaseably attach to the sheet.

In an embodiment, the package includes a plurality of sheets disposed inside the housing. The consumable products releaseably attach to each of the plurality of sheets.

In an embodiment, the consumable products are releaseably attached to either side of each of the plurality of sheets.

In another embodiment of the present invention, a package for consumable products is provided. The package includes a plurality of wrappers enclosing the consumable products. The wrappers are removably adhered to a sheet. A housing contains the sheet, the wrappers and the products. An outer wrapping seals about the outside of the housing.

In an embodiment, the products are confectionery products.

In an embodiment, the products are gum.

In still a further embodiment of the present invention, a package for a consumable product is provided. The package includes a housing having a pair of opposing walls. An adhesive area is deposited on an inner surface of at least one of the opposing walls. The consumable product releasably adheres to the adhesive area of the housing.

In an embodiment, the adhesive area is heat activated to adhere the consumable product to the adhesive area of the housing.

In an embodiment, the adhesive area is a wax area disposed to the inner surface of the at least one wall, the wax area heat activated to adhere the consumable product to one of the walls.

In a further embodiment of the present invention, a method for packaging consumable products is provided. The method includes the step of removably coupling the consumable products to a sheet. Next, the sheet and coupled products are placed into a housing. The sheet and coupled products are positioned and the housing is configured so that a consumer can readily grasp, uncouple and remove one of the products.

In an embodiment, the method includes placing the sheet and coupled products snugly into a housing so that the sheet and products cannot fall out of the housing.

In an embodiment, the method includes attaching the sheet to the housing so that the sheet and products cannot fall out of the housing.

In an embodiment, the step of removably coupling the consumable products to a sheet includes placing a product on the sheet and heating the sheet where the product is placed to activate an adhesive.

An advantage of the present invention is to provide an improved package for consumable products that is reusable.

Another advantage of the present invention is to provide an improved package for consumable products that secures products within the package even when partially empty.

Further, an advantage of the present invention is to provide an improved package for consumable products, wherein the products are readily accessible and removable.

Moreover, an advantage of the present invention is to provide an improved method for packaging a consumable product that enables an adhesive holding the product to the sheet to be heat activated.

Additional features and advantages of the present invention will be described in and apparent from the detailed description of the presently preferred embodiments.

DETAILED DESCRIPTION OF THE PRESENTLY PREFERRED EMBODIMENTS

Figure 1:
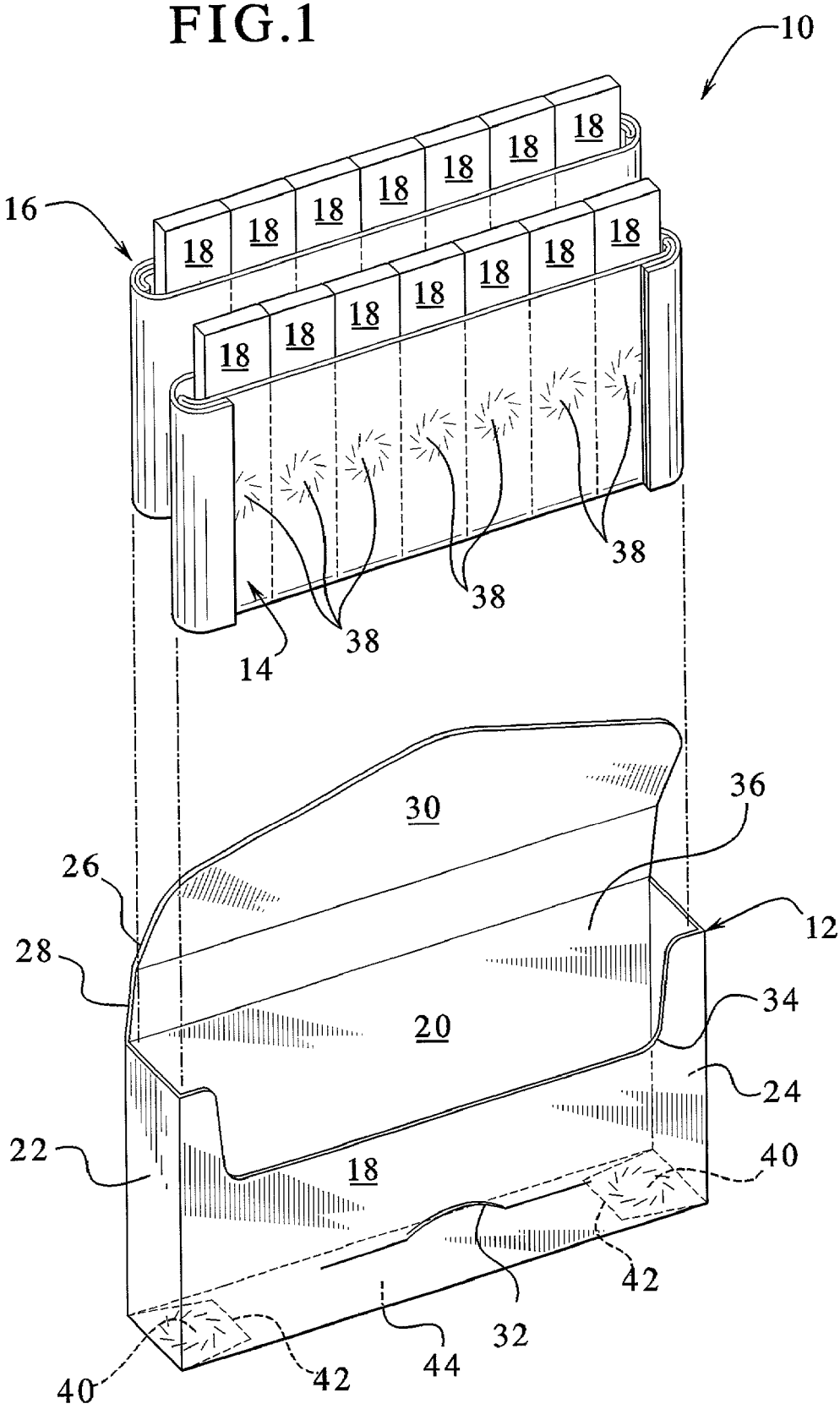
FIG. 1 is an exploded perspective view of an embodiment of the product package having the releaseably held products of the present invention.

Referring now to the drawings and in particular to FIG. 1, an embodiment of the package 10 of the present invention is illustrated. The package 10 in the illustrated embodiment includes a housing 12, a sheet 14 and a sheet 16. The sheets 14 and 16 in an embodiment wrap around and enclose a plurality of products 18. Although the package 10 in a preferred embodiment is designed to be used to house consumable or confectionery products, e.g., gum, the package 10 can be used to house other products, e.g., pharmaceuticals.

The housing 12 includes a front wall 18, a rear wall 20, a plurality of side walls 22 and 24 and a lid 26. The lid 26 includes a top 28 and a flap 30. The flap 30 folds into a slit 32 defined by the front wall 18. The front wall 18 also defines a cutout 34.

The walls of the housing define an opening 36 which enables one or more sheets 14 and/or 16 to insert into the housing 12. The cutout 34 aids a consumer in removing one or more of the products 18 from one of the sheets 14 or 16. The top 28 and flap 30 of the lid 26 cover the opening 36 when the flap 30 inserts into the slit 32.

Although not illustrated, when the sheets 14 and 16 are originally packaged into the housing 12, the flap 30 is folded into the slit 32. Also, an outer wrapping (not illustrated) wraps and seals around the housing 12, so that the consumer must permanently remove the outer wrapping in order to remove the flap from the slit 32. The outer wrapping in a preferred embodiment is a thin clear plastic, which enables the consumer to view any writing or indicia provided on the outside of the housing 12.

Although FIG. 1 illustrates two product bearing sheets 14 and 16 insertable into the housing 12, the present invention includes any number of such product bearing sheets, such as one sheet or multiple sheets. The sheet or sheets can define, if desired, an envelope or sleeve-like structure. In the illustrated embodiment, the sheets 14 and 16 are shown wrapped around the products 18. In other embodiments, the sheets can include non-folded or single strips onto which the products are attached.

The package 10 of the present invention remedies the problem of inadvertent product removal by attaching or adhering the products 18 to the sheets 14 and 16. The products 18 are removably attached to the sheets 14 and 16. In the preferred embodiment illustrated, the sheet 14 or 16 includes a plurality of adhesive areas 38. The adhesive areas 38 adhere the products 18 to a surface of the sheets 14 or 16. The adhesive areas 38 in an embodiment are wax areas alternatively, the adhesive areas 38 include any adhesive suitable for consumable product packaging. In the illustrated embodiment, the adhesive areas 38 adhere the products 18 to an inner surface of the loop or wrapping created by the sheets 14 and 16.

In an embodiment, a single side of each product 18 attaches to a surface of the sheet 14 or 16 via the adhesive or wax area 38. In an alternative embodiment, a plurality of sides of the product 18 adhere to a plurality of inner surfaces of the sheets 14 and 16. In this alternative embodiment, it should be appreciated that the sheets 14 and 16 must wrap around or cover at least two sides of the products 18.

The package 10 also enables the products 18 to be readily disattached and removed from the housing 12. Therefore, in a preferred embodiment, the package 10 does not over-tighten or over-stuff the sheets 14 and 16 into the housing 12. Consequently, it may be necessary to provide a number of adhesive areas 40 (e.g., wax areas) in the housing 12, which adhere the sheets 14 and 16 to the inside of the housing 12. In the illustrated embodiment, the adhesive areas 40 are applied to corner tabs 42 which form part of the structure of the housing 12. The corner tabs 42 fold inwardly above a bottom wall 44 of the housing 12 and create an area of double thickness, which provides a suitable area for supporting and attaching the sheets 14 and 16. Obviously, other areas of the bottom wall 44, front wall 18, rear wall 20, side wall 22 and side wall 24 could also or alternatively contain adhesive areas 40 that attach the sheets 14 and 16 to the housing 12. The sheets 14 and 16 do not need to release from each other. Therefore, the adhesive areas or wax areas 40 connecting the sheets 14 and 16 can be sized to form stronger bonds than the areas connecting the products 18 to the sheets 14 and 16.

Further in certain embodiments having multiple sheets 14 and 16, one or more of the sheets 14 and 16 may be adapted to have one or more adhesive areas or wax areas (not illustrated) that hold the sheets together. Connecting or attaching the sheets also aids in preventing a single one of the sheets 14 or 16 from inadvertently coming loose from the housing 12 of the package 10. The sheets 14 and 16 do not need to release from each other.

It should be appreciated that it may be possible to press-fit the sheets 14 and 16 into the housing 12, without adhesive, wherein tension holds the sheets in place, but wherein the consumer can still readily retrieve the products 18. Even in this situation, the individual products 18 must still be releasably adhered to the sheets 14 and 16.

In an alternative embodiment (not illustrated), the products 18 directly attach or adhere to the housing 12. That is, this alternative embodiment does not require a separate sheet such as the sheets 14 and 16. Here, the adhesive areas or wax areas 38 are applied directly to the inner surface of the front wall 18, the inner surface of the rear wall 20. The housing 12 may be adapted to additionally or alternatively directly place adhesive areas or wax areas on the side walls 22 and 24 and/or the bottom wall 44.

Figure 2:
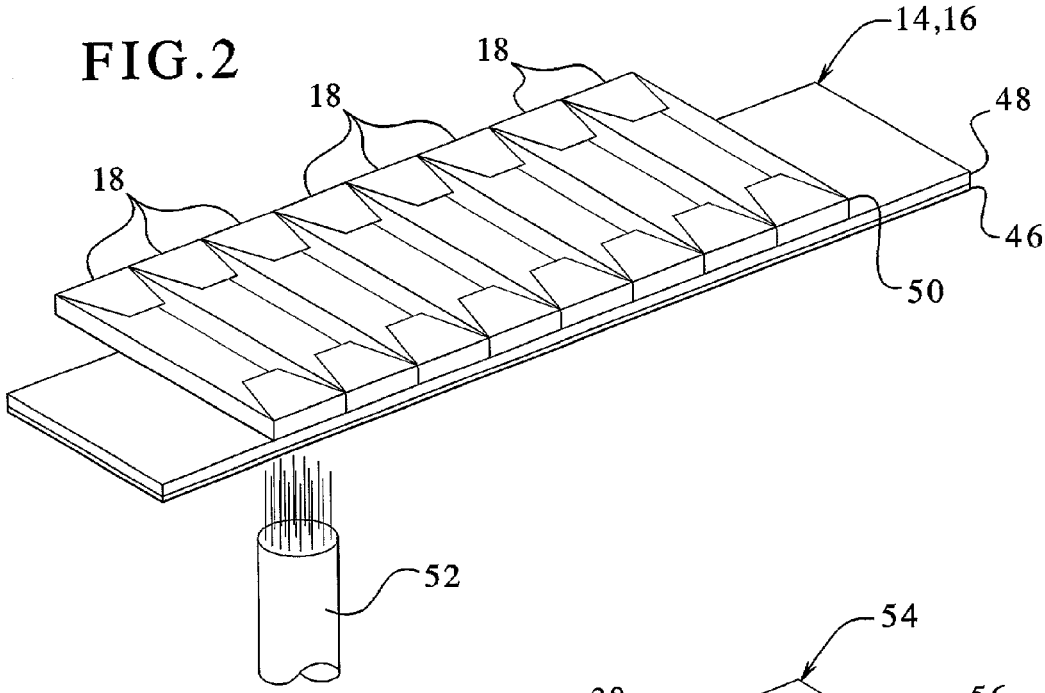
FIG. 2 is a perspective view of an embodiment of the present invention, wherein products are being adhered to a sheet of the package.

Referring now to FIG. 2, an embodiment of one of the sheets 14 or 16 of FIG. 1 is shown not wrapped or in an alternative strip configuration so that a preferred method of attaching the products 18 to the sheet 14 or 16 may be illustrated. In the preferred embodiment, the adhesive or wax areas 38 adhere to a foil layer 46. The sheet 14 or 16 in the illustrated embodiment includes a wax paper layer 48 attached to the foil layer 46. The foil layer 46 in an embodiment is a metal foil such as an aluminum foil or other light metal foil. The wax paper 48 is any type of wax paper known to those of skill in the art. The wax paper layer 48 adheres to the foil layer 46 via a standard adhesive. Alternatively, the foil layer 46 can be sprayed on or otherwise applied to the paper side of the wax paper layer 48.

Regardless of whether adhesive areas (wax areas) 38 or the wax paper layer 48 is employed, a plurality of products 18 reside on and attach to the wax areas 38 or the wax side of the wax paper layer 48. Any number of products 18 may be applied in this manner. The products 18 extend past the width of the sheet 14 or 16, so that the consumer can grasp and remove the products 18 via the extended portion. In an embodiment, the products 18 are closely packaged so as to make efficient use of the space on the sheet 14 or 16. The consumer, however, has sufficient room to grasp and remove one or more of the products 18 from the sheet 14 or 16 and from the container 12.

The products 18 are illustrated in FIG. 2 having individual wrappers 50. That is, the wrapper 50 surrounds a single product 18, wherein the wrapper adheres to the wax areas 38 or the wax paper layer 48. In FIG. 1, the product 18 adheres directly to the sheet 14 or 16. The present invention includes directly adhering the product 18 to a sheet or wrapping the product 18 in a wrapper 50 and adhering the product 18 and wrapper 50 to the sheet 14 or 16. Although wrapper 50 preferably wraps around a single piece or product 18, the wrapper 15 alternatively encloses multiple products 18.

In an embodiment, a heat source 52 is applied to the foil layer 46 side of the sheet 14 or 16. The heat source 52 applies a localized heating such as a hot air jet to heat a particular area of the foil layer 46. The foil layer 46 in turn heats the adhesive or wax areas 38 or the wax paper layer 48 in a desired area so that the wax in either case melts and dries to the wrapper 50 of the product 18. If the product 18 is of a suitable type, the wax may be melted and dried directly to the product 18.

Although not illustrated, a larger heat source may be applied to melt multiple adhesive or wax areas 38 or heat the wax paper layer 48 so that a number of products 18 are simultaneously adhered to the sheets 14 or 16. The bond between the sheets 14 and 16 and the products 18 is controlled in an embodiment by the size of the adhesive or wax area 38. That is, if the manufacturer wishes to make the attachment more secure and thereby make the removal more difficult, the manufacturer applies larger areas 38 and thereby heats more wax. If the manufacturer desires to make removal easier, the manufacturer applies a smaller area 38 heats less wax.

In the illustrated embodiment, a suitable bond may be made without heating the entire wax paper layer 48. The wax paper layer 48, however, allows a degree of flexibility in the present invention, wherein the manufacturer can heat more or less of the wax paper layer 48 to provide a more or less secure attachment.

Any type of heat source that can provide a localized area of heating may be employed to melt the wax and form the bond with the product 18 directly or the product 18 in combination with the wrapper 50. The heat source 52 can employ conductive heating, convective heating, radiated heating or any combination thereof. The level or amount of heat (i.e., temperature of heat and length of heating time) is preferably less than that which would melt or otherwise damage or distort the products 18 or the wrappers 50.

The adhesive or wax areas 38 or the wax paper layer 48 in an alternative embodiment is applied directly to any inner surface of the housing 12 including the front wall 18 and/or the rear wall 20 shown in FIG. 1. By doing so, the product 18 may be either directly adhered to the housing 12, e.g., to the wall 18 or 20, or may be adhered to one or more of the walls via the wrapper 50.

Figure 3:
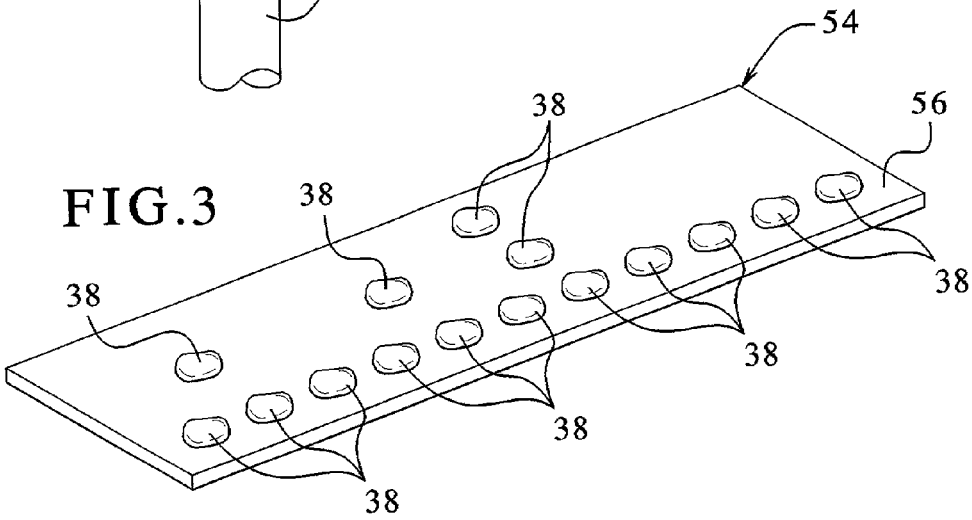
FIG. 3 is a perspective view of an alternative embodiment of a sheet of the present invention to which products are adhered.

Referring now to FIG. 3, a sheet 54 is illustrated having beaded adhesive or wax areas 38. The sheet 54 includes a substrate 56 and a plurality of the areas 38 that align with the products 18 in a similar manner as is shown in FIG. 2. The adhesive areas 38 may include any type of adhesive suitable for packaging consumable goods known to those of skill in the art. The adhesive areas 38 are applied in a quantity sufficient to adhere a product 18 directly or in combination with a wrapper 50 to the alternative sheet 54. As shown, more than one adhesive or wax area 38 can be beaded or applied for a single product 18.

The substrate 56 can be a paper material, plastic material, metal material or any combination thereof. The substrate 56 can be formed as a single strip as illustrated, or the substrate 56 can be wrapped around or folded about the products 18 as illustrated in FIG. 1. The substrate 56 can be of a single ply or have multiple layers. If wrapped about the products 18, the substrate 56 in an embodiment is permanently deformable so that the wrapped substrate remains folded without any additional need for an adhesive. In an alternative embodiment, an adhesive may be employed to hold the substrate 56 in a wrapped position about the products 18.

The adhesive or wax areas 38 are illustrated beaded in single portions wherein each adhesive area 38 adheres to a single product 18 or product in a wrapper 50. In an alternative embodiment, the adhesive areas 38 may be beaded or provided in a width that spans two or more products 18. Further alternatively, one or more elongated strips of adhesive may be applied to the substrate 56 to collectively adhere all of the products 18 to the alternative sheet 54. The adhesive areas 38 in an embodiment are applied to the alternative sheet 54, whereby the products 18 are placed on the sheet and a heat source such as heat source 52 heats the adhesive areas to activate the adhesive. In another embodiment, the adhesive areas 38 do not require the addition of heat in order to adhere the products 18 to the alternative sheet 54.

Figure 4:
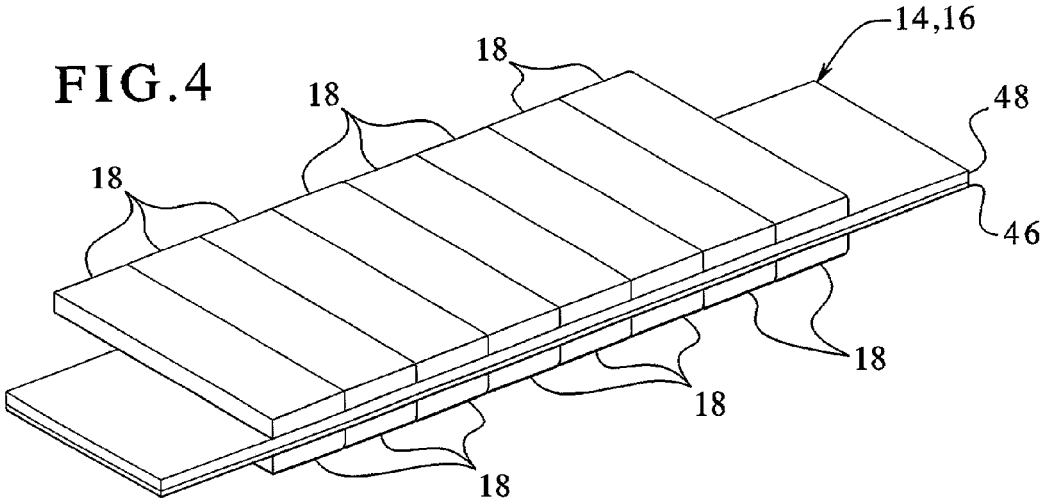
FIG. 4 is a perspective view of an alternative embodiment of a sheet having multiple rows of adhered products of the present invention.

Referring now to FIG. 4, a combination of the previously disclosed embodiments provides one possible way to adhere products 18 to both sides of one of the sheets 14 or 16. The sheets 14 and 16 have the foil metal layer 46 and the wax paper layer 48 as described above. The sheets 14 or 16 may wrap around the upper row of products 18 or the lower row of products 18 in a similar manner as disclosed in connection with FIG. 1. Further, the sheets 14 or 16 may be constructed so as to be able to wrap around both the upper row of products 18 and the lower row of products 18.

The top row of products 18 adhere to the adhesive areas or the wax paper side of the sheet 14 or 16 as described previously. Of course, the products 18 may directly adhere to the adhesive areas 38 or the wax paper 48. The products 18 can alternatively be wrapped in individual wrappers 50 and thereby adhere to the areas 38 or wax paper 48. After this upper row of products is adhered to the sheet 14 or 16, the bottom row of products 18 is adhered to the outside of the foil metal layer 46 of the sheet 14 or 16 using the adhesive areas 38, which do not require additional heat.

The bottom row of adhesive areas 38 may be applied to the foil metal layer 46 before or after the upper row of products 18 adheres to the wax paper layer 48. Preferably, however, the upper row of products 18 is first adhered to the sheet 14 or 16 using the heat source described above in connection with FIG. 2. Then the products 18 are adhered to adhesive areas 38, which preferably does not require additional heat for activation.

The amount of wax that is heated to adhere product 18 to the sheets 14 or 16 preferably creates roughly the same strength of bond as does the adhesive area 38 on the bottom side of the foil sheet 46. In such a way, the consumer does not experience a different tactile sensation when removing the product 18 from either side of the sheet 14 or 16.

In any of the previous embodiments disclosed above, one or a plurality of the sheets may be inserted into and adhered to the housing 12. Using the embodiment disclosed in connection with FIG. 4, multiple sheets 14 or 16 each having multiple rows of products 18 may be placed inside the container 12 so that four or more rows of products 18 are available to the consumer.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A package for housing consumable products comprising:

a housing including a plurality of walls that define an opening and a lid hingedly connected to one of the walls, the lid adapted to cover the opening;

a sheet disposed inside the housing; and a plurality of consumable products releaseably attached to either side of the sheet, the products configured within the housing so that a consumer can grasp and remove at least one of the consumable products from the sheet and the housing, wherein the sheet is attached to an inner wall of the housing.

2. The package of claim 1, wherein the housing includes a plurality of walls that define an opening and one of the walls defines a cutout that assists the consumer in grasping and removing the at least one product.

3. The package of claim 1, wherein the sheet includes a plurality of adhesive areas and the consumable products releaseably adhere to the adhesive areas of the sheet.

4. A package for housing consumable products comprising:

a housing including a plurality of walls that define an opening and a lid releaseably covering the opening;

a sheet disposed inside the housing; and a plurality of consumable products releaseably attached to the sheet, the products configured within the housing so that a consumer can grasp and remove at least one of the consumable products from the sheet and the housing, wherein the sheet includes a plurality of adhesive areas and the consumable products releaseably adhere to the adhesive areas of the sheet and the adhesive areas are heat activated to adhere the consumable products to the sheet.

5. The package of claim 1, wherein the sheet includes a plurality of wax areas and the consumable products releaseably adhere to the wax areas of the sheet.

6. The package of claim 1, wherein the sheet loops around the products and one side of the products releaseably attaches to an inner surface of the looped sheet.

7. The package of claim 1, wherein the sheet loops around the products and multiple sides of the products releaseably attach to inner surfaces of the looped sheet.

8. The package of claim 1, wherein the products directly contact the sheet.

9. The package of claim 1, wherein the products are individually contained in wrappers, the wrappers are releaseably attached to the sheet.

10. The package of claim 1, which includes a plurality of sheets disposed inside the housing.

11. A package for housing consumable products comprising:

a housing including a a plurality of walls that define an opening and a lid releaseably covering the opening;

a sheet disposed inside the housing, the sheet including a plurality of adhesive areas;

a plurality of consumable products releaseably attached to the adhesive areas of the sheet, the products configured within the housing so that a consumer can grasp and remove at least one of the consumable products from the sheet and the housing; and wherein the sheet is attached to an inner wall of the housing.

12. A package for housing consumable products comprising:

a housing including a plurality of walls that define an opening and a lid releaseably covering the opening;

a sheet disposed inside the housing, the sheet including a plurality of adhesive areas;

a plurality of consumable products releaseably attached to the adhesive areas of the sheet, the products configured within the housing so that a consumer can grasp and remove at least one of the consumable products from the sheet and the housing; and wherein the adhesive areas are heat activated to be adhere the consumable products to the sheet.

13. A package for housing consumable products comprising:

a housing;

a sheet disposed inside the housing, the sheet including a plurality of wax areas; and a plurality of consumable products releaseably attached to the wax areas of the sheet, the products configured within the housing so that a consumer can grasp and remove at least one of the consumable products from the sheet and the housing.

14. A package for housing consumable products comprising:

a housing;

a sheet disposed inside the housing, the sheet including a plurality of adhesive areas;

a plurality of consumable products releaseably attached to the adhesive areas of the sheet, the products configured within the housing so that a consumer can grasp and remove at least one of the consumable products from the sheet and the housing; and wherein the sheet loops around the products and one side of the products is releaseably attached to an inner surface of the looped sheet.

15. A package for housing consumable products comprising:

a housing;

a sheet disposed inside the housing, the sheet including a plurality of adhesive areas;

a plurality of consumable products releaseably attached to the adhesive areas of the sheet, the products configured within the housing so that a consumer can grasp and remove at least one of the consumable products from the sheet and the housing; and wherein the sheet loops around the products and multiple sides of the products are releaseably attached to inner surfaces of the looped sheet.

* * * * *